US005742319A

United States Patent [19]

Fukunaga et al.

[11] Patent Number: 5,742,319

[45] Date of Patent: Apr. 21, 1998

[54] IMAGE FORMING APPARATUS HAVING EASILY REPLACEABLE COMPONENTS

[75] Inventors: Keizo Fukunaga, Ikoma; Yoshinobu Tateishi, Nara; Yuhi Akagawa, Ikoma; Mitsuyoshi Terada, Nara, all of Japan

[73] Assignee: Sharp Kabushiki Kaisha, Osaka, Japan

[21] Appl. No.: 407,654

[22] Filed: Mar. 21, 1995

[30] Foreign Application Priority Data

Apr. 12, 1994 [JP] Japan ..... 6-073341

[51] Int. Cl.[6] ..... B41J 2/385; G03G 13/04

[52] U.S. Cl. ..... 347/138; 347/140; 399/113

[58] Field of Search ..... 347/138, 140, 347/245, 263; 355/200, 210, 211, 245, 282, 298; 399/130, 134, 271, 113, 112, 119, 124

[56] References Cited

U.S. PATENT DOCUMENTS 5,221,943 6/1993 Hasegawa ..... 347/138

FOREIGN PATENT DOCUMENTS 1-32984 7/1989 Japan .
3-67272 3/1991 Japan .
3-75667 3/1991 Japan .

*Primary Examiner*—Benjamin R. Fuller
*Assistant Examiner*—L. Anderson

[57] ABSTRACT

An image forming apparatus having a main body whose upper section is split into first and second split lid sections. The first and second split lid sections are arranged to be freely opened and closed. A transfer body and a fixing device are detachably installed in the first split lid section, while a developing device and an image carrying body are installed in the second split lid section. The image carrying body and the transfer body are brought out of contact with each other by opening at least one of the first and second split lid sections. The transfer body and a fixing member are caused to be rotatable by opening the first lid section. With this structure, it is possible to easily repair a paper jam and perform maintenance of the respective sections without increasing the installation space.

18 Claims, 9 Drawing Sheets

IMAGE FORMING APPARATUS HAVING EASILY REPLACEABLE COMPONENTS

FIELD OF THE INVENTION

The present invention relates to an image forming apparatus, such as a laser printer and a copying machine, for achieving easy maintenance of processing units requiring frequent maintenance checks.

BACKGROUND OF THE INVENTION

In some of conventional image forming apparatuses such as laser printers and copying machines, for example, as disclosed in Tokukohei (Japanese Publication for Examined Patent Application) No. 1-32984, when replacing toner during the course of maintenance of the image forming apparatus, respective units of a photoreceptor drum and a developer container are pulled out from the side of the main body of the apparatus while sliding the units along rails, toner is replaced, and then the units are pushed back into the main body thereof.

Tokukaihei (Japanese Publication for Unexamined Patent Application) No. 3-67272 discloses a full-color image forming apparatus in which developer containers storing yellow, magenta, cyan and black toner, respectively, a cleaning device, a charger and a photoreceptor drum are included in a process cartridge as a unit, and the unit is taken out of and placed into the main body of the apparatus from the upper section thereof.

However, in this conventional image forming apparatus, since a slide rail member must be provided in the main body of the apparatus, a problem arises in order to achieve a reduction of the size of the main body. Moreover, if developer containers for various colors are included, the weight of the unit is increased. It is therefore necessary to give a sufficient strength to the rail for sliding the unit in a forward direction and to a supporting member for supporting the rail, resulting in an increase in the weight of the apparatus. Namely, it becomes difficult to achieve a light-weight apparatus.

Furthermore, when replacing the unit, in general, the unit is first drawn out from the side of the apparatus and then lifted for the need to remove the unit from the main body. In short, the unit is removed from the main body through the two steps of actions. Such a structure requires quite a time to replace the unit, and a large installation space for the apparatus because of the space required for the replacement of the unit.

In addition, in this apparatus, when replacing the developer container, the photoreceptor drum unit must be removed from the main body of the apparatus. Therefore, in order to prevent the drum surface of the removed photoreceptor drum unit from being damaged by the removal action and external light, it is necessary to provide a shutter for covering and uncovering the drum surface. Thus, a reduction in the cost of the photoreceptor drum unit is prevented.

Besides, in the latter image forming apparatus, since the photoreceptor drum and four developer containers storing yellow, magenta, cyan and black toner, respectively, are included in the process cartridge as a unit, the weight of the unit alone becomes extremely great. Additionally, there is a need to take out such a heavy process cartridge from the main body of the apparatus every time toner is replaced. Consequently, supplying toner sets an operator considerably heavy work.

SUMMARY OF THE INVENTION

It is an object of the present invention to provide an image forming apparatus allowing easy maintenance without increasing the installation space.

In order to achieve the above object, the present invention is an image forming apparatus having a main body whose upper section is freely opened and closed, including:

- a photoreceptor unit having a rotating photoreceptor drum on a supporting shaft, the photoreceptor unit being attachable to and detachable from the main body;
- a detachable and attachable developing unit disposed in the vicinity of the photoreceptor drum; and
- a guide section, installed in the main body, for retracting the photoreceptor unit by guiding the supporting shaft, when replacing the developing unit by opening the upper section of the main body, so that the developing unit is separated from the photoreceptor unit and guided outward from the main body.

With this structure, there is no need to take out the photoreceptor drum from the main body when replacing the development unit. It is thus possible to prevent scratches and external light from giving vicious effects on the photoreceptor drum when it is removed from the main body in a conventional manner. Additionally, easy maintenance is achieved without increasing the installation space.

Another image forming apparatus of the present invention includes:

- a main body whose upper section is split into first and second split lid sections which are freely opened and closed;
- an image carrying body having a surface on which a toner image corresponding to an electrostatic latent image is formed during a rotation thereof;
- a developing device disposed around the image carrying body;
- a transfer body which rotates together with and in contact with the image carrying body, holds transported recording paper between the transfer body and the image carrying body, and transfers the toner image on the image carrying body to the recording paper; and
- a fixing device having a fixing member, for fixing the toner image on the recording paper with a rotation of the fixing member,
- wherein the transfer body and the fixing device are detachably installed in the first split lid section, and the developing device and the image carrying body are installed in the second split lid section, and
- wherein the image carrying body and the transfer body are brought out of contact with each other by opening at least one of the first and second split lid sections, and the transfer body and the fixing member become rotatable by opening the first split lid section.

With this structure, when replacing the developing device and the image carrying body, since a sufficient space for installation and removal through the upper section of the main body is ensured, the operations are performed in an improved manner. Moreover, since the upper section of the main body is split into two parts, a desired replacement operation is carried out by minimum opening and closing movements in accordance with types of replacement operations. For instance, the toner is replaced by opening the second split lid section, while the waste toner is replaced by opening the first split lid section.

For a fuller understanding of the nature and advantages of the invention, reference should be made to the ensuing detailed description taken in conjunction with the accompanying drawings.

DESCRIPTION OF THE PREFERRED EMBODIMENTS

The following description discusses one embodiment of the present invention with reference to FIGS. 1 to 7.

Figure 2:
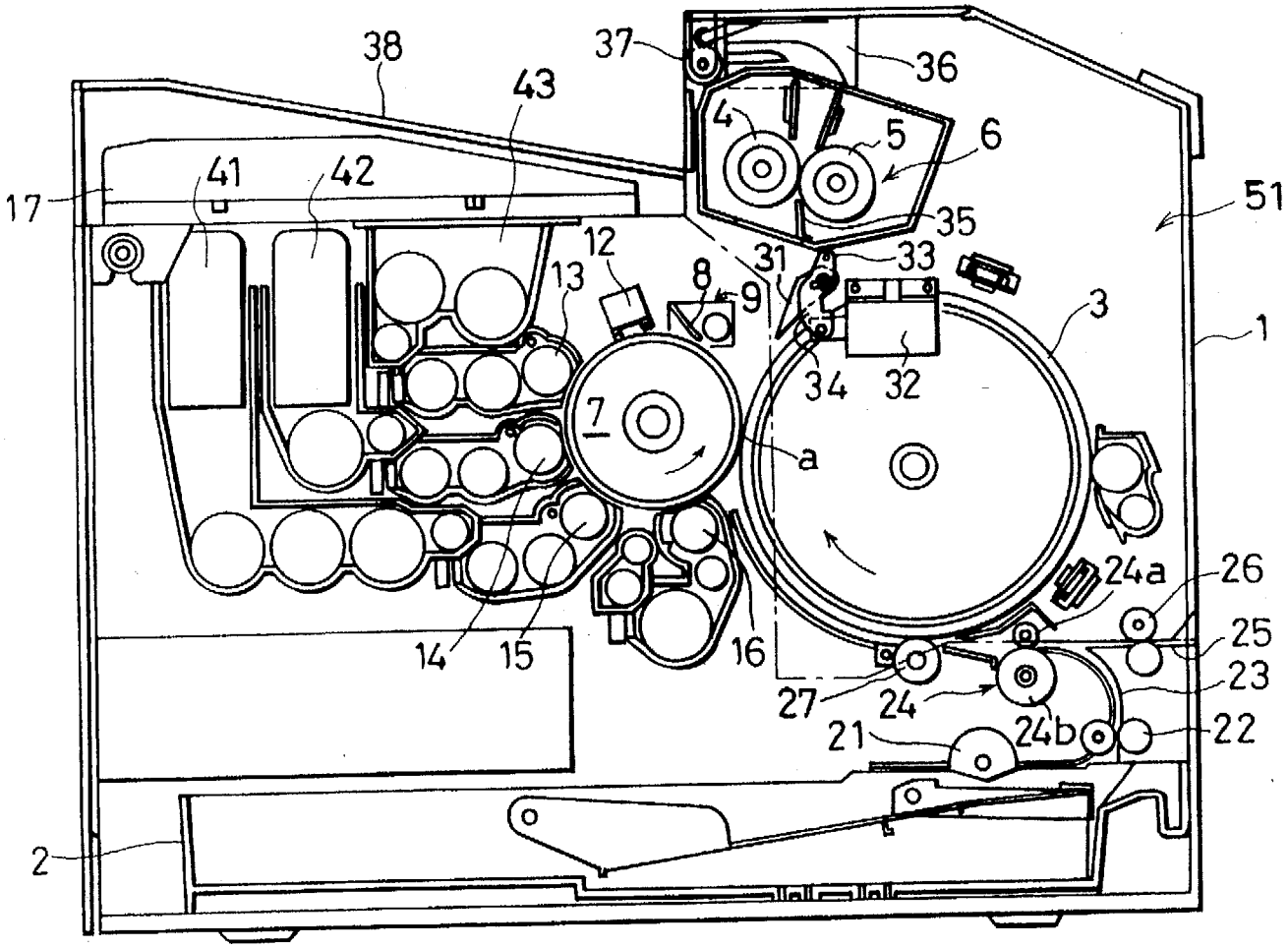
FIG. 2 is a front view showing the internal structure of the laser beam printer.

As illustrated in FIG. 2, a laser beam printer as an image forming apparatus of the present invention includes a paper cassette 2 for storing sheets of recording paper (not shown). The paper cassette 2 is disposed in a bottom section of a main body 1 of the apparatus. A transfer drum 3 as a transfer body is positioned above the paper cassette 2 on the discharge side (the right side in FIG. 2). Also disposed above the transfer drum 3 is a fixing unit 6 as a fixing device including a heat roller 4 and a press roller 5.

A photoreceptor drum 7 as an image carrying body of a diameter smaller than that of the transfer drum 3 is disposed on the left side of the transfer drum 3 in FIG. 2. The photoreceptor drum 7 is arranged to rotate together with and in contact with the transfer drum 3. Disposed on the upper right side of the periphery of the photoreceptor drum 7 is a cleaning unit 9 including a toner scraping blade 8 for removing toner remaining on a surface of the photoreceptor drum 7. Also disposed around the periphery of the photoreceptor drum 7 are a charger 12 for uniformly charging the surface of the photoreceptor drum 7, and first to fourth developing apparatuses 13 to 16 for supplying yellow, magenta, cyan and black toner, respectively, to the surface of the photoreceptor drum 7. These members are arranged in this order in the counterclockwise direction.

Additionally, an optical system unit 17 is provided on the upper left side of the main body 1. The optical system unit 17 includes therein a semiconductor laser, a polygon mirror, an fθ lens, and a reflecting mirror, not shown. Emitted light from the optical system unit 17 is applied to the surface of the photoreceptor drum at a position between the charger 12 and the first developing device 13. When the surface is exposed, an electrostatic latent image is formed at a predetermined position on the surface of the photoreceptor drum 7. For example, if yellow toner is supplied when the electrostatic latent image comes to a position .facing the first developing device 13, a yellow toner image is formed on the surface of the photoreceptor drum 7. The yellow toner image is then transported in the counterclockwise direction toward a contact point a of the photoreceptor drum 7 and the transfer drum 3 by a rotation of the photoreceptor drum 7.

The following description explains the structure along a transport path of the recording paper and operations in the main body 1.

A pickup roller 21 which is rotated intermittently is installed above the end of the paper cassette 2 on the paper discharge side. The topmost sheet of the recording paper stored in the paper cassette 2 is pushed out of the paper cassette 2 by one rotation of the pickup roller 21. The recording paper is then transported along a U-shaped paper transport path 23 to pre-curl rollers (PS rollers) 24 located near the lowest section of the transfer drum 3.

The paper transport path 23 includes a manual-feed path 25 which branches and runs to form an opening on the front side of the main body 1. When feeding an envelope, for example, a manual-feed guide (not shown) is set in the opening and the envelope is inserted into the main body 1 along the manual-feed guide. With this arrangement, similarly to the above, the inserted envelop is fed to the PS rollers 24 by manual-feel rollers 26 installed on the manual-feed transport path 25.

The PS rollers 24 are designed for curling recording paper so as to facilitate adhesion of the recording paper to the outer surface of the cylindrical transfer drum 3. The PS rollers 24 are formed by an upper roller 24*a* made of a rigid body and a lower roller 24*b* made of an elastic body of a low rigidity. By feeding the recording paper through a pressed section in the form an arc at the contact of these rollers, the curled recording paper is fed out.

A grand roller 27 is pressed against the outer surface of the transfer drum 3 at the lowest section thereof. The curled recording paper is transported to the contact section between the grand roller 27 and the transfer drum 3.

The transfer drum 3 has a three-layer structure with the outmost layer made of a dielectric layer, and a high voltage is applied from the inside thereof. On the other hand, the ground roller 27 is earthen. When the recording paper passes through a contact area between the transfer drum 3 and the ground roller 27, charges are induced on a surface of the recording paper in accordance with the charge accumulated on an inner surface of the dielectric layer of the transfer drum 3, thereby causing electrostatic adhesion of the recording paper to the surface of the transfer drum 3. As a result, the transfer paper is held on the transfer drum by adhesion and is rotated together with the transfer drum 3.

Figure 3:
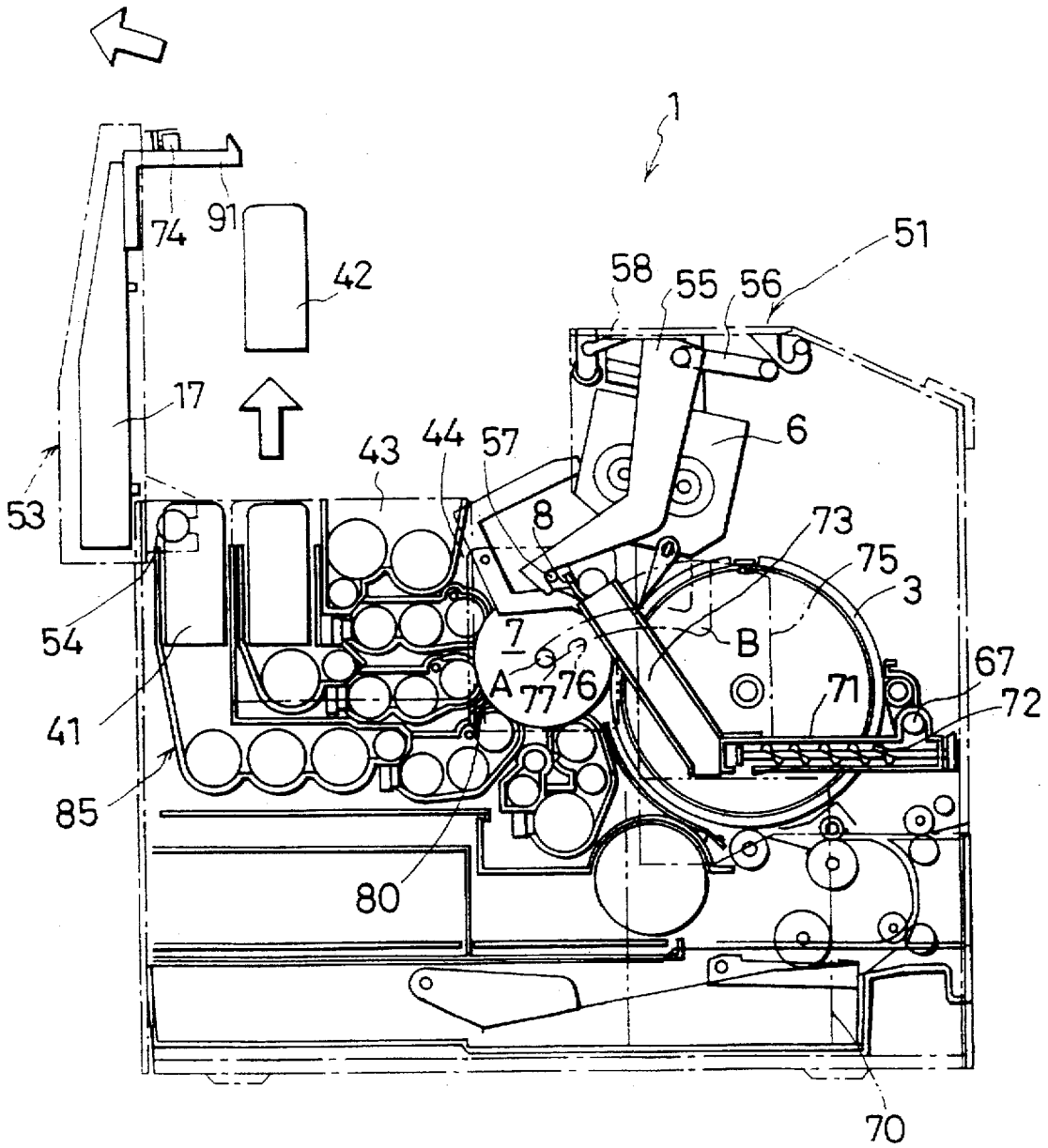
FIG. 3 is a front view showing a state in which a toner cartridge is taken out by opening the developing-side split lid section.

When the transfer drum 3 is rotated clockwise in FIG. 3, the recording paper adhering to the transfer drum 3 is transported to a transfer area that is the contact section a of the photoreceptor drum 7 and the transfer drum 3. When the recording paper passes through the area, a toner image formed on a surface of the photoreceptor drum 7 is transferred to the recording paper by a potential difference between the charge of the toner and the charge on the recording paper surface.

As described above, the developing apparatuses 13 to 16 of various colors (yellow, magenta, cyan and black) are radially disposed around the photoreceptor drum 7. Moreover, toner cartridges 41 to 44 (44 is not shown in FIG. 2) as developer containers are provided in the vicinity of the developing apparatuses 13 to 16. In order to produce a color image, a series of charging, exposure, developing and transfer operations are performed repeatedly for the respective colors. At this time, the recording paper is rotated together with the transfer drum 3 while being held on the transfer drum 3 by adhesion. One color is transferred by one rotation, and a color image is formed by a maximum of four rotations.

In addition, a separating claw 31 is mounted in the vicinity of the outer surface of the transfer drum 3 at a position between the transfer area and the fixing unit 6 located above the transfer area. A solenoid 32 is disposed on a side wall surface of the main body 1. The separating claw 31 is connected to the solenoid 32 by a supporting shaft 33 and a driving arm 34. The separating claw 31 is rotated on the supporting shaft 33 by switching the solenoid 32 between on and off. Therefore, the position of the pointed end of the separating claw 31 is changed between a distant position which is separated from the outer surface of the transfer drum 3 by a predetermined distance and a contact position where the pointed end comes into contact with the outer surface of the transfer drum 3 as shown in FIG. 2.

As described above, when producing a color image by rotating the transfer drum 3 four times, the separating claw 31 is kept in the distant position until the last toner image is transferred. When a sheet to which the last toner image has been transferred is transported from the transfer area, the separating claw 31 is moved from the distant position to the contact position.

As a result, the recording paper is lifted up by the pointed end of the separating claw 31, forced to separate from the outer surface of the transfer drum 3, and guided to the fixing unit 6 along an upper sloping surface of the separating claw 31.

As described above, the recording paper which has been separated from the transfer drum 3 by the separating claw 31 and transported to the fixing unit 6 is moved upward through a fixing section that is the contact section between the heat roller 4 and a press roller 5 by a fixing guide 35. At this time, the toner on the recording paper is fused by the heat and pressure of the fixing section. The recording paper fed from the fixing unit 6 is guided toward the left by a paper discharge guide 36 located above the fixing unit 6, and output onto a top cover 38 covering the optical system unit 17 by the discharge roller 37.

Figure 1:
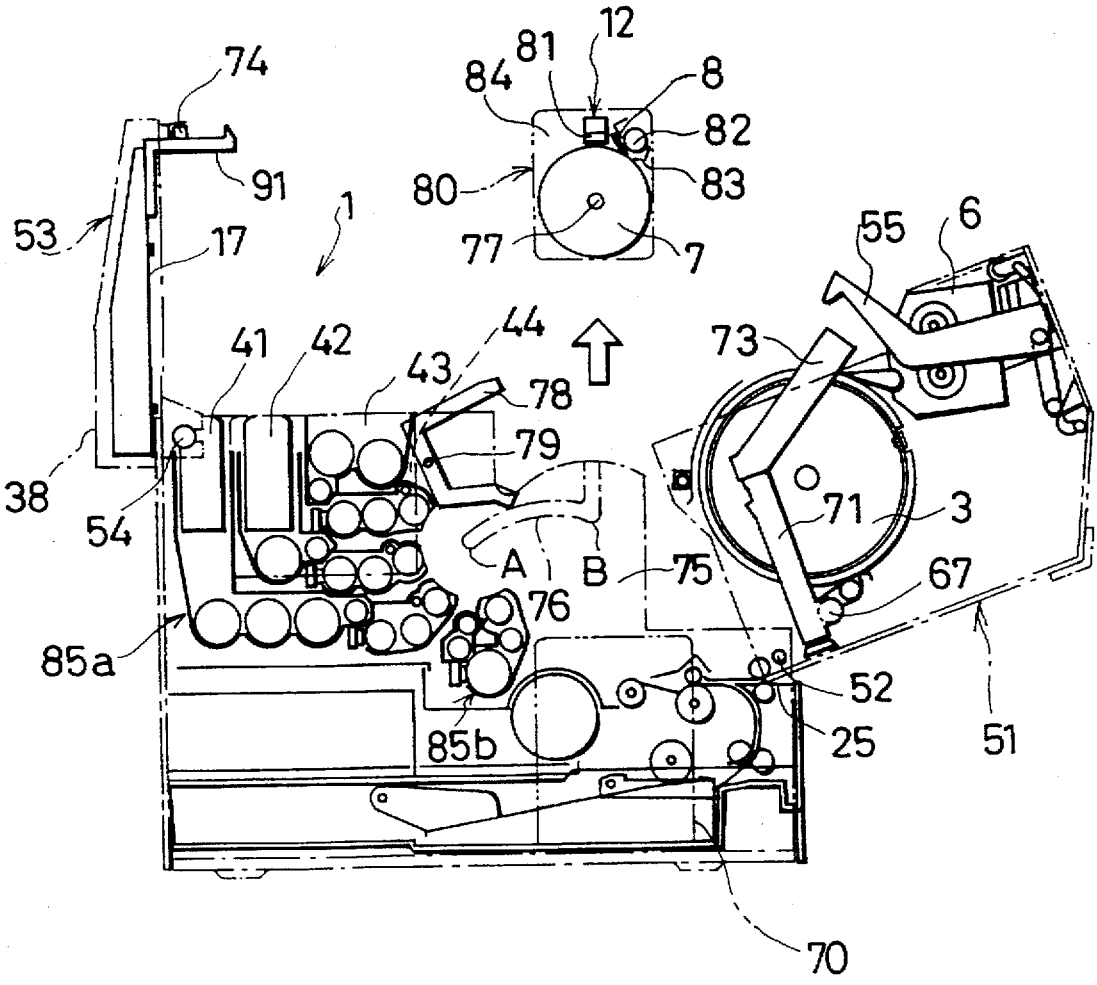
FIG. 1 is a front view showing a state in which a photoreceptor unit is taken out of a laser beam printer according to one embodiment of the present invention by opening a transfer-side split lid section and a developing-side split lid section of the laser beam printer.

On the other hand, in the laser beam printer of this embodiment, as illustrated in FIG. 2, the upper section of the main body 1 is split into two parts, i.e., front and rear parts, shown as the right side and left side in FIG. 2. Specifically, one of the parts functioning as a transfer-side split lid section 51 is removable from the main body 1 from a separating line shown by the alternate long and short dash line. As illustrated in FIG. 1, the transfer-side split lid section 51 is freely opened and closed by rotationally moving it in an upward direction (a clockwise direction in FIG. 1) on a rotation supporting shaft 52 located in the vicinity of the manual-feed transport path 25. The transfer drum 3 and the fixing unit 6 are detachably installed in the transfer-side split lid section 51.

The other part that serves as a developing-side split lid section 53 includes the optical system unit 17 and the top cover 38. The developing-side split lid section 53 is freely opened and closed by rotationally moving it in an upward direction (a counterclockwise direction in FIG. 1) on a rotation supporting shaft 54 located in a rear section (on the left in FIG. 1) of the main body 1. The toner cartridges 41 to 44 as developer containers of a plurality of colors are disposed below the developing-side split lid section 53.

The following description discusses a mechanism for opening and closing the transfer-side split lid section 51 and the developing-side split lid section 53, a disassembly mechanism inside the main body 1, and waste toner discarding mechanism in the laser beam printer of this embodiment.

First, as illustrated in FIG. 3, mounted in the upper section of the transfer-side split lid section 51 is a locking hook 55 for preventing the transfer-side split lid section 51 from being easily opened when the main body 1 is operated. The locking hook 55 is pivotable on a supporting point located at the substantially center thereof. One of the ends of the locking hook 55 is attached to an elastic body 56 such as a spring, while the other end is formed in the shape of a hook so as to be locked with a locking boss 57 of a frame 75 of the main body 1, to be described later.

Figure 4:
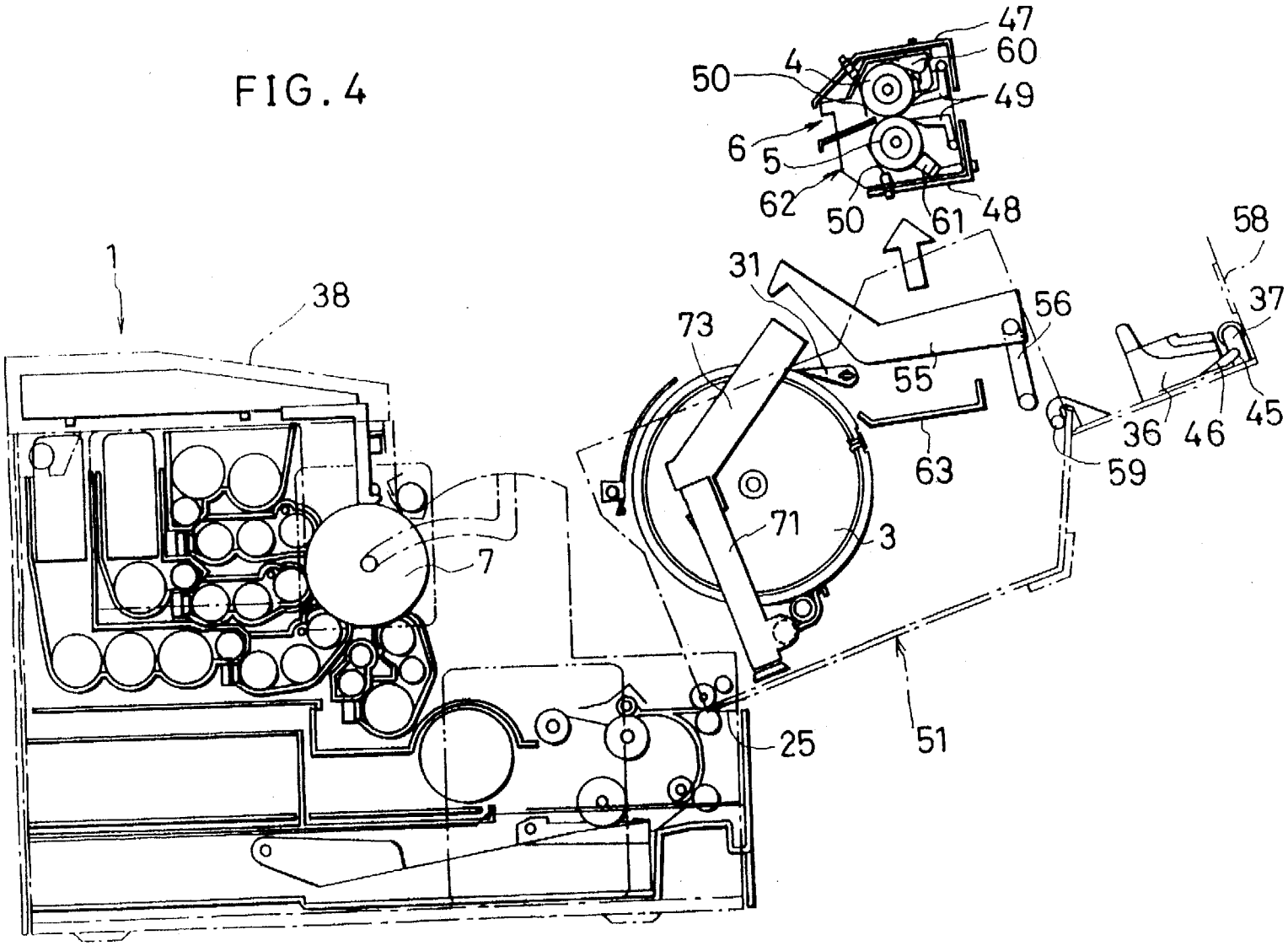
FIG. 4 is a front view showing a state in which a fixing unit is taken out by opening the developing-side split lid section and a sheet paper discharge cover.

As illustrated in FIG. 4, a paper discharge cover 58 in the vicinity of the fixing unit 6 in the transfer-side split lid section 51 is opened by rotating it on the rotation shaft 59. Disposed on a rear surface of the paper discharge cover 58 are a driven roller 45, and roller holding section 46 as well as the paper discharge guide 36 and the discharge roller 37.

When the paper discharge cover 58 is opened, the fixing unit 6 becomes detachable. The fixing unit 6 includes upper and lower separating claws 49, temperature detecting thermisters 50, a silicon oil pat 60, a cleaner pat 61 and a fixing frame 62 for holding these members as well as the heat roller 4 and the press roller 5 between the upper cover 47 and the lower cover 48. The fixing unit 6 is installed on a fixing and holding plate 63 in the transfer-side split lid section 51, and is electrically connected to the main body 1 through a connector (not shown).

Figure 5:
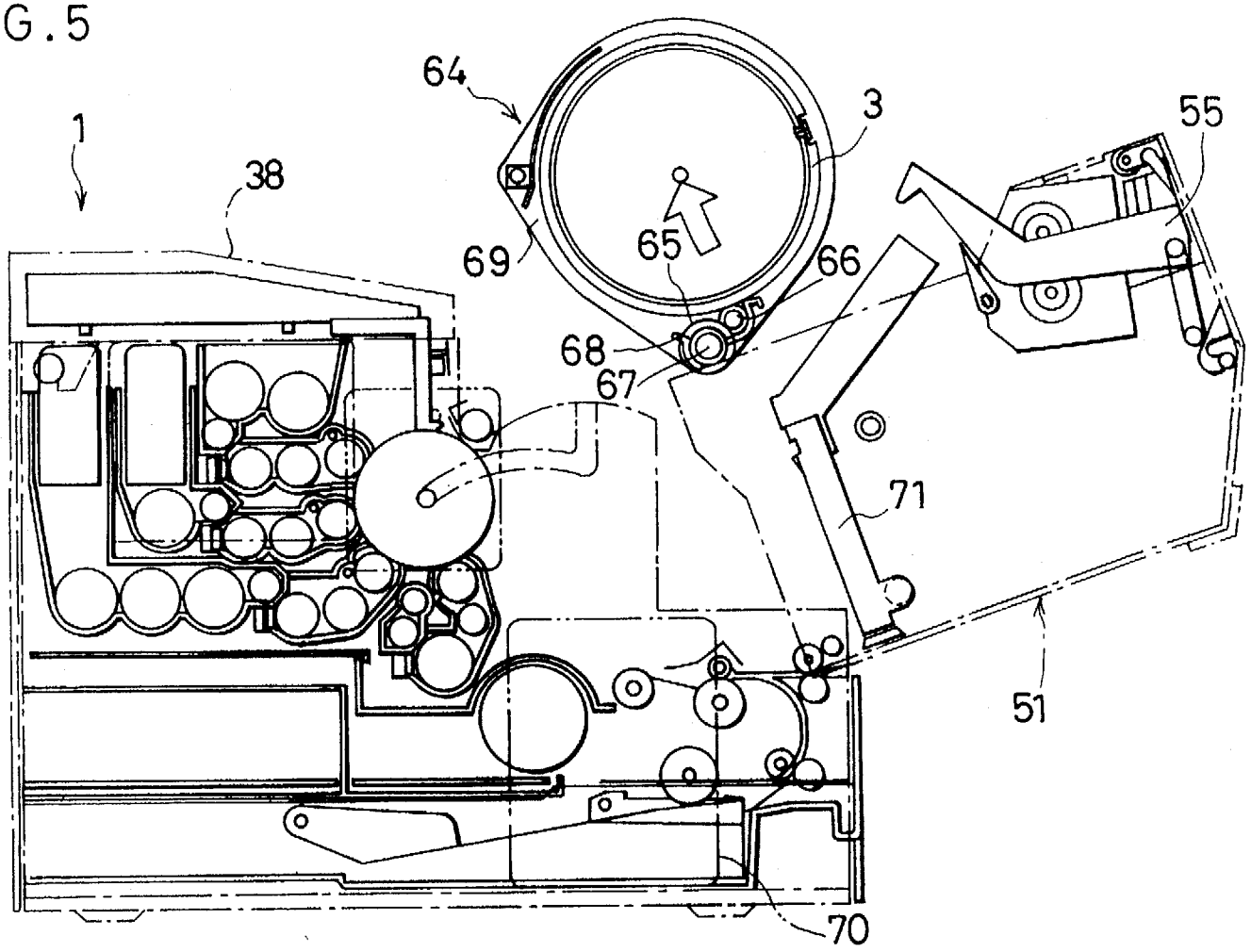
FIG. 5 is a front view showing a state in which a transfer drum unit is taken out by opening the developing-side split lid section.

Moreover, in this embodiment, as illustrated in FIG. 5, the transfer drum 3 is freely detachable by detaching a transfer drum unit 64. More specifically, the transfer drum unit 64 includes a blade, for example, rubber for removing toner remaining on the surface of the transfer drum 3, a blush 66, a conveyer for feeding toner to the side surface of the transfer drum 3 as to be described later, a shutter 68 for preventing the toner from spilling upon the removable of the transfer drum unit 64, and a transfer drum frame 69 for holding these members as well as the transfer drum 3.

As illustrated in FIG. 3, in this embodiment, the waste toner is thrown away into a waste toner box 70 installed below the transfer-side split lid section 51 of the main body 1. This structure is achieved by providing the conveyer 67 for guiding the waste toner scraped off from the circumferential surface of the transfer drum 3 to the side surface of the transfer drum 3, and a conveyer 71, connected to the conveyer 67, for guiding the waste toner to the waste toner box 70. A screw 72 is installed inside the conveyers 67 and 71 so as to enable the transport of waste toner.

Furthermore, a transport pipe 73 is obliquely installed at the end of the conveyer 71 so that the waste toner scraped by the toner scraping blade 8 passes through the transport pipe 73 and is guided to the waste toner box 70.

Figure 6:
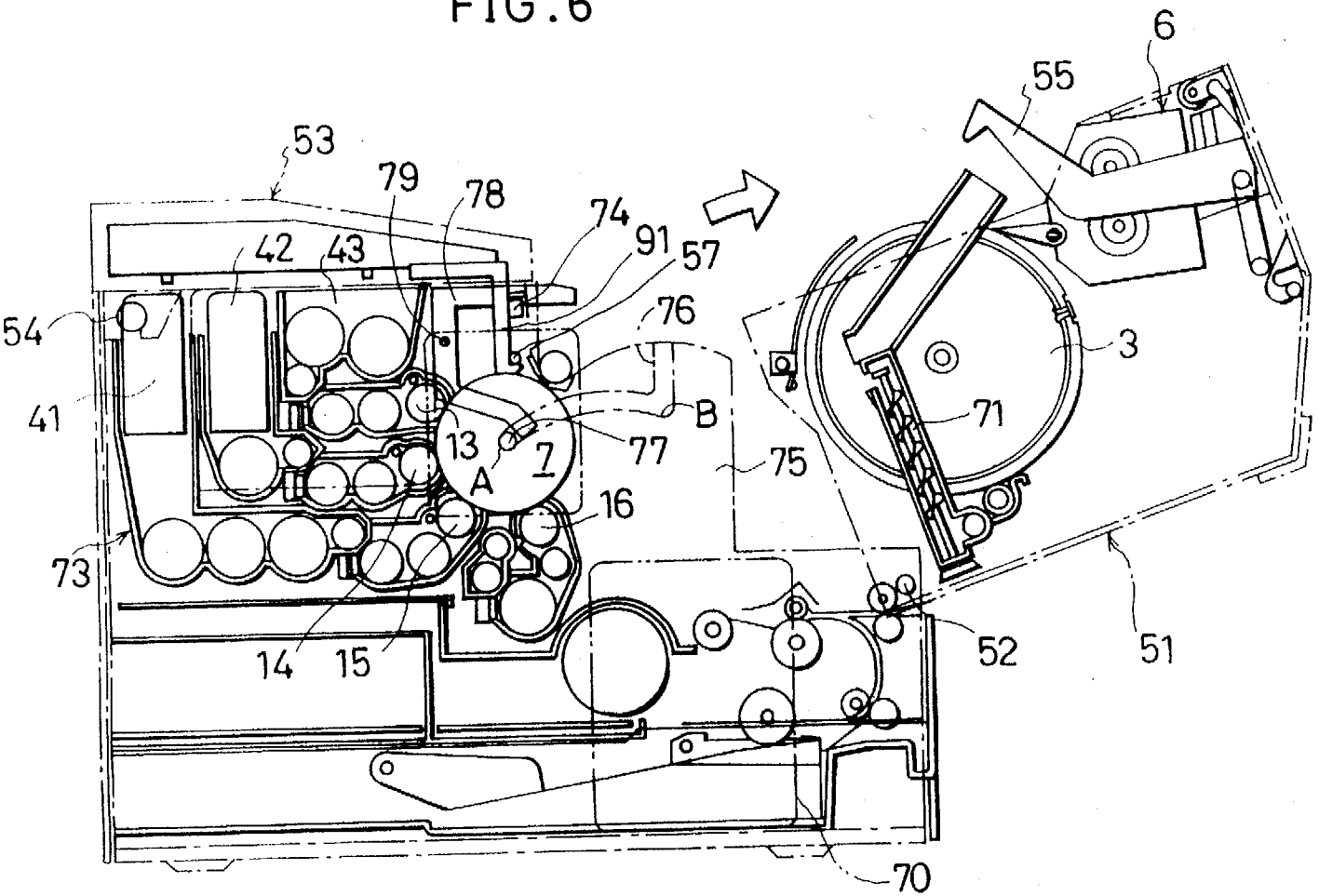
FIG. 6 is a front view showing a state in which a photoreceptor drum is supported at an operation position in a guide groove in the laser beam printer.

In addition, as illustrated in FIG. 3, the developing-side split lid section 53 includes a locking hook 91 at the edge thereof. When the developing-side split lid section 53 is closed, the locking hook 91 is locked with the locking boss 57 as shown in FIG. 6. The locking hook 91 has a charge removing lamp 74 which uniformly irradiates the surface of the photoreceptor drum 7 and removes the charge by neutralization so as to achieve an initialized state.

The photoreceptor drum 7 is arranged so that a rotation supporting shaft 77 thereof is guided by a guide groove 76 formed as a guiding section in the main body frame 75 as a moving member. The main body frame 75 is located in the vicinity of the rear side of an outer wall surface of the main body 1. The guide groove 76 is formed into an L shape. When the rotation supporting shaft 77 is located at an end of the L-shaped guide groove 76, the photoreceptor drum 7 is in an operation position A that is a normal position. By contrast, when the rotation supporting shaft 77 is moved laterally to the corner of the L-shaped guide groove 76, the photoreceptor drum 7 is retracted from the operation position A and enters to a retracted position B.

In the frame 75, a substantially U-shaped holding plate 78 is mounted so that it is freely rotatable on a shaft 79 located at the substantially center thereof. When the developing-side split lid section 53 is opened, one end of the holding plate 78 is pushed upward by a spring, not shown, and protrudes from the main body 1. As illustrated in FIG. 6, when the developing-side split lid section 53 is closed, an edge thereof comes into contact with one end of the holding plate 78 and rotates the holding plate 78 on the shaft 79. At this time, the other end of the holding plate 78 pushes the rotation supporting shaft 77 in the operation position A, and therefore the photoreceptor drum 7 is fixed at the operation position A.

Since the top end of the L-shaped guide groove 76 is open, when the photoreceptor drum 7 is moved upward, the photoreceptor drum 7 is freely removed from the retracted position B along the guide groove 76.

Namely, as illustrated in FIG. 1, the photoreceptor drum 7 is detachable by a removal of the photoreceptor unit 80. The photoreceptor unit 80 includes the charger 12, a charging electrode 81, for example, a wire and an needle electrode mounted in the charger 12, a cleaning unit 9 having the toner scraping blade 8, the waste toner transport roller 82 and the toner receiving sheet 83, and the photoreceptor frame 84 for holding these members as well as the photoreceptor drum 7 having the rotation supporting shaft 77.

Figure 7:
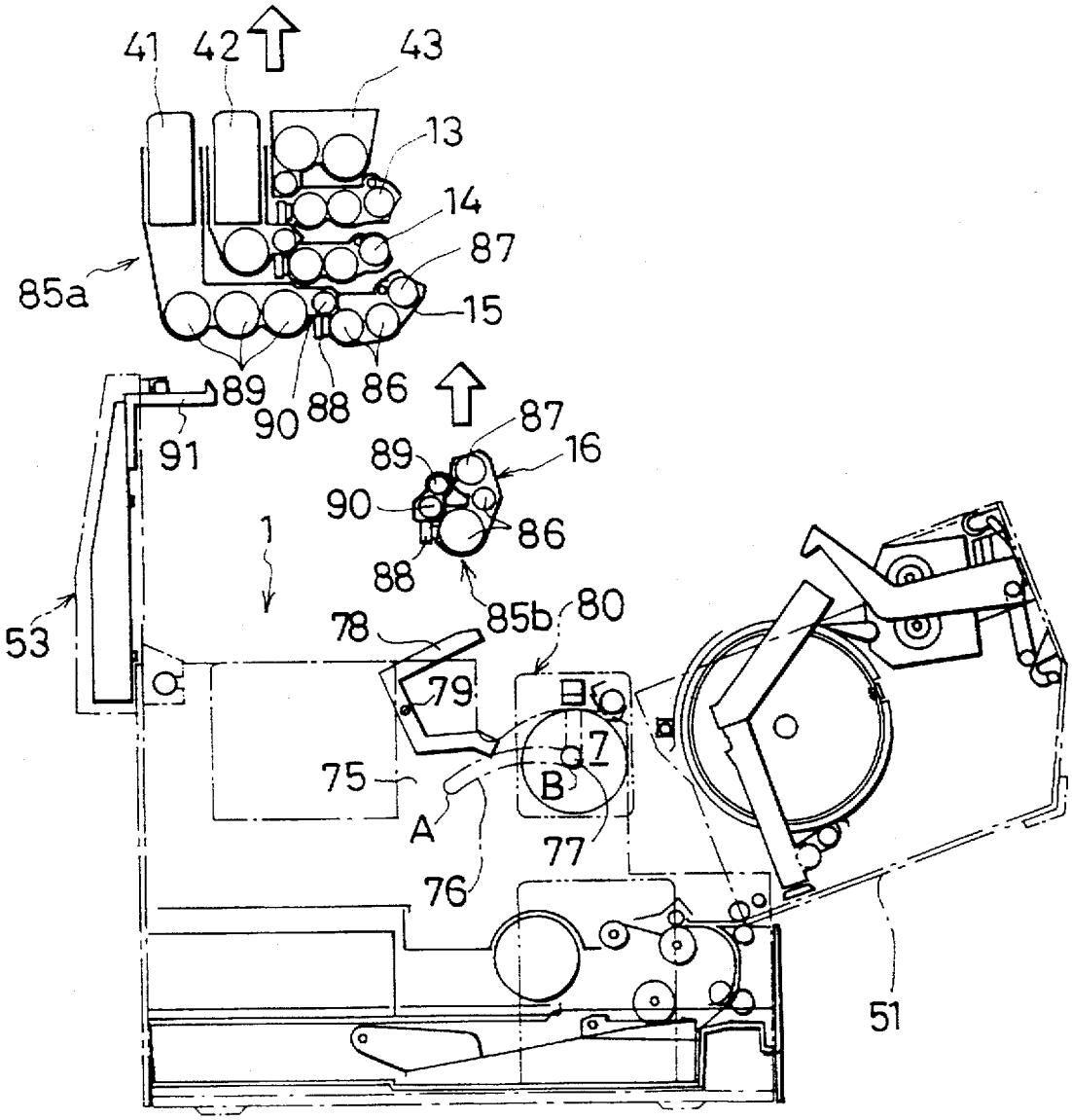
FIG. 7 is a front view showing a state in which a developing unit is taken out by moving the photoreceptor drum to a retracted position in the guide groove.

In this embodiment, as illustrated in FIG. 7, (a) a color developing unit 85*a* as a developing device having the first to third developing apparatuses 13 to 15 and the toner cartridges 41 to 43, and (b) a black developing unit 85*b* as a developing device having a fourth developing apparatus 16 and a toner cartridge (not shown) are respectively removable as units. The color developing unit 85*a* includes the first to third developing apparatuses 13 to 15 and the toner cartridges 41 to 43. In each of the developing apparatuses 13 to 15, mixing rollers 86 for charging color toner and carrier by friction, an MG roller 87 for bringing the toner into contact with the surface of the photoreceptor drum 7 through a magnetic blush, a toner-concentration sensor 88 for detecting a toner concentration, toner transport rollers 89 for transporting the toner in a toner hopper, and a toner supply roller 90 for supplying toner so as to maintain a uniform toner concentration. Similarly, the black developing unit 85*b* includes the mixing rollers 86, the MG roller 87, the toner-concentration sensor 88, the toner transport rollers 89 and the toner supply roller 90.

In the laser beam printer having the above-mentioned structure, maintenance of the inside of the main body 1 is performed as follows.

First, when removing paper which causes a paper jam, as illustrated in FIG. 6, the locking hook 55 of the transfer-side split lid section 51 is disengaged from a locking boss 57 (see FIG. 3) by operating a lever (not shown). Second, the transfer-side split lid section 51 is opened by rotationally moving the transfer-side split lid section 51 in an upward direction (clockwise direction in FIG. 3) on the rotation point 52. This causes the photoreceptor drum 7 and the transfer drum 3 to be out of contact with each other. As a result, the recording paper held between the photoreceptor drum 7 and the transfer drum 3 is exposed and thus easily removed.

Moreover, when the transfer-side split lid section 51 is opened, the driving path of the photoreceptor drum 7 and the transfer drum 3 is separated. Consequently, the transfer drum 3, and the heat roller 4 and press roller 5 in the fixing unit 6 become freely rotatable. This arrangement facilitates the removal of recording paper even when a paper jam occurs in the fixing unit 6.

Next, how toner is supplied is explained below.

When supplying toner, as illustrated in FIG. 3, the locking hook 91 of the developing-side split lid section 53 at the upper section of the main body 1 is disengaged from the locking boss 57. Then, the developing-side split lid section 53 is opened by rotationally moving the developing-side split lid section 53 in an upward direction (counterclockwise direction in FIG. 3) on the rotation point 54. As a result, the toner cartridges 41 to 44 in the color developing unit 85*a* and the black developing unit 85*b* (hereinafter referred to as the developing units 85*a*, 85*b*) are exposed, thereby facilitating the replacement of the toner cartridges 41 to 44.

The following description discusses how the maintenance of the main body 1, for example, the replacement of the units is performed.

First, how the transfer drum 3 and the fixing unit 6 in the transfer-side split lid section 51 are replaced is explained below. An object of replacing the transfer drum 3 is to prevent a lowering of transfer performance due to a deteriorated surface of the transfer drum 3 when used for a long time. The deteriorated surface is caused by, for example, the contact between the surface of the transfer drum 3 and the blade or the blush 66 when removing the excessive toner adhering to the surface of the transfer drum 3 during the operation of the transfer drum 3 or at the occurrence of a paper jam, the separation of the adhering recording paper, or scratches made by the separating claw 31.

When replacing the transfer drum 3, as illustrated in FIG. 5, the transfer drum unit 64 is completely replaced. Similarly to the operation performed for eliminating the paper jam, first, the transfer-side split lid section 51 is opened. Second, the transfer drum unit 64 is removed from the side-surface transport conveyer 71. At this time, since the joint of the circumferential-surface transport conveyer 67 and the side-surface transport conveyer 71 is opened, the shutter 68 is closed so as to prevent the toner from spilling.

When replacing the fixing unit 6, as illustrated in FIG. 4, the paper discharge cover 58 covering the fixing unit 6 is opened by rotating it on the rotation shaft 59 while the transfer-side split lid section 51 is opened. The replacement of the fixing unit 6 is performed by removing it from the holding plate 63.

Next, how the developing units 85*a*, 85*b* and the photoreceptor unit 80 are replaced is explained below.

Similarly to the replacement of toner, when replacing the developing units 85*a*, 85*b*, as illustrated in FIG. 3, the developing-side split lid section 53 is opened. At this time, since the developer units 85*a*, 85*b* are closely in contact with the photoreceptor drum 7, the developer units 85*a*, 85*b* cannot be removed by moving them in an upward direction when the developing-side split lid section 53 remains opened.

However, in this embodiment, the photoreceptor drum 7 is movable in a lateral direction from the operation position A to the retracted position B along the guide groove 76. It is possible to remove the developer unit 85*a*, 85*b* by moving them in the upward direction.

Namely, when removing the developing units 85*a*, 85*b*, as illustrated in FIG. 7, the developing-side split lid section 53 is also opened after opening the transfer-side split lid section 51. When the developing-side split lid section 53 is opened, the holding plate 78 is rotated counterclockwise on the shaft 79 by a spring, not shown. Consequently, the locking of the position of the rotation supporting shaft 77 of the photoreceptor drum 7 to the operation position A in the guide groove 76 is released, allowing a lateral movement of the rotation supporting shaft 77 along the guide groove 76. Then, the rotation supporting shaft 77 is moved laterally from the operation position A to the retracted position B along the guide groove 76 in the frame 75. As a result, the developing units 85*a*, 85*b* and the photoreceptor drum 7 come out of contact with each other, and the replacement of the developing units 85*a*, 85*b* is performed by moving the developing units 85*a*, 85*b* upward as illustrated in FIG. 7. Moreover, since the toner cartridge 44 used in the black developing unit 85*b* has a large capacity, it is removed from the black toner developing unit 85*b* at a joint (not shown) by leaving a toner hopper section (not shown) containing the toner cartridge 44 in the main body 1.

When replacing the photoreceptor unit 80, in FIG. 7, since the guide groove 76 is raised vertically from the retracted position B of the photoreceptor drum 7 and since the top end thereof is open, the photoreceptor unit 80 is easily removed and replaced by just lifting the photoreceptor unit 80 in an upward direction.

As described above, in the laser beam printer of this embodiment, the upper section of the main body 1 is split into front and rear parts, and at least a transfer-side split lid section 51 is arranged to be freely opened and closed by a rotational movement thereof, and includes therein the transfer drum 3 and the fixing unit 6. Therefore, when a paper jam occurs between the transfer drum 3 and the photoreceptor drum 7, they are caused to come out of contact with each other by opening the transfer-side split lid section 51. As a result, recording paper held between the photoreceptor drum 7 and the transfer drum 3 is exposed, allowing easily removal of the recording paper.

Moreover, since the driving path of the photoreceptor drum 7 and the transfer drum 3 is separated when the transfer-side split lid section 51 is opened, the transfer drum 3, and the heat roller 4 and press roller 5 in the fixing unit 6 become freely rotatable. It is thus possible to easily remove the recording paper even when a paper jam occurs inside the fixing unit 6.

Furthermore, since the transfer drum 3 and the fixing unit 6 are detachably installed inside the transfer-side split lid section 51, maintenance of the transfer drum 3 and the fixing unit 6 is easily performed.

Since a plurality of toner cartridges 41 to 44 are disposed below the developing-side split lid section 53, a toner supply operation in the toner cartridges 41 to 44 is easily performed by opening the developing-side split lid section 53 by a rotational movement thereof.

In addition, when carrying out maintenance, since the upper section of the main body 1 is opened by a rotational movement thereof, the transfer-side split lid section 51 and the developing-side split lid section 53 are not drawn in a lateral direction. Thus, there is no need to ensure a space in the lateral direction for moving and drawing the main body 1.

It is therefore possible to easily carry out maintenance without increasing the installation space. Consequently, increases in the cost and the weight of the apparatus are prevented.

In this embodiment, the developing-side split lid section 53 is designed to be freely opened and closed, and the frame 75 having the guide groove 76 is installed below the developing-side split lid section 53. In general, the photoreceptor drum 7 is supported in the operation position A in the guide groove 76 in the frame 75. However, when removing the developing units 85*a*, 85*b* by moving them in an upward direction, the photoreceptor drum 7 is moved in a lateral direction to the retracted position B along the guide groove 76. As a result, the developing units 85*a*, 85*b* and the photoreceptor drum 7 are separated from each other. Therefore, even when the developing units 85*a*, 85*b* are in close contact with the photoreceptor drum 7, the developing units 85*a*, 85*b* become freely detachable. Moreover, since there is no obstruction in the upward direction, the developing units 85*a*, 85*b* are easily removed by moving them in the upward direction.

It is therefore possible to easily perform maintenance without increasing the installation space.

In order to take out the photoreceptor drum 7 for maintenance purposes, the developing-side split lid section 53 is opened by a rotational movement thereof, and the photoreceptor drum 7 is laterally moved to the retracted position B in the guide groove 76. Since the guide groove 76 is formed so as to guide the photoreceptor drum 7 to be freely moved in the upward direction from the retracted position B, it is possible to easily take out the photoreceptor drum 7 by moving it in the upward direction along the guide groove 76.

When taking out the photoreceptor drum 7, the photoreceptor drum 7 must be moved once from the operation position A to the retracted position B. It is thus possible to prevent scratches and external light from giving vicious effects on the photoreceptor drum 7 when it is carelessly removed from the main body 1. Thus, maintenance is easily performed without increasing the installation space.

In this embodiment, although the guide section is formed by the guide groove 76, this is not particularly limited, and therefore the photoreceptor drum 7 may be guided, for example, by a rail.

Figure 8:
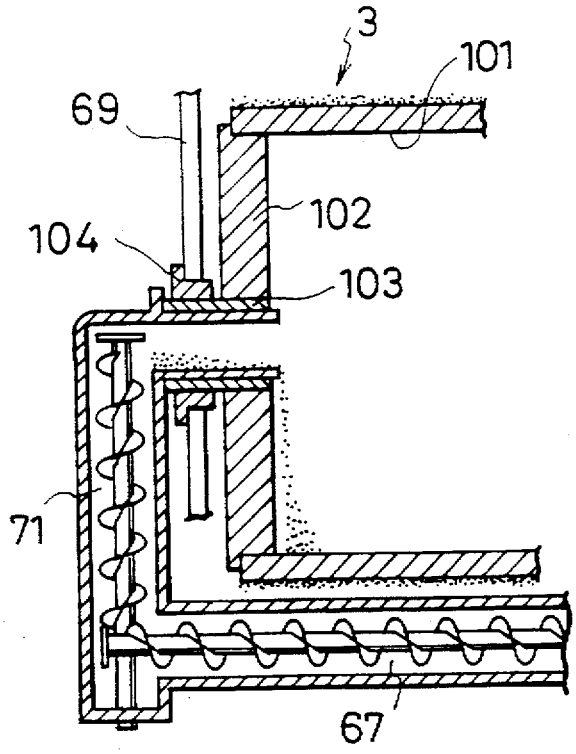
FIG. 8 is a cross section showing the structure of a storage section formed in a transfer drum of a laser beam printer according to another embodiment of the present invention.
Figure 9:
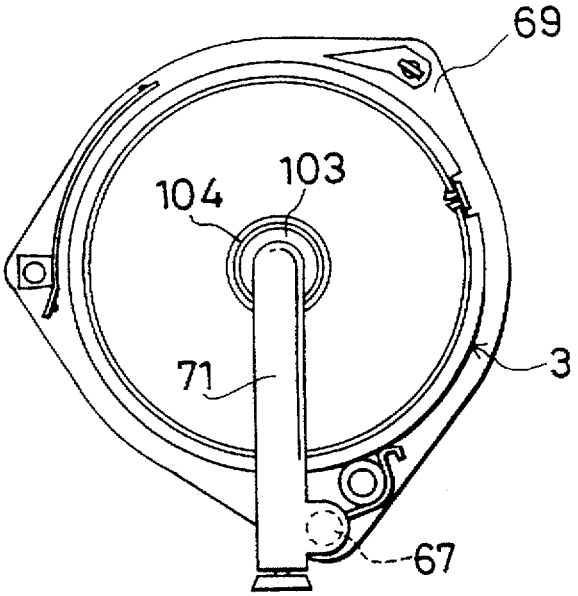
FIG. 9 is a side view showing the structure of the transfer drum.

The following description discusses another embodiment of the present invention with reference to FIGS. 8 and 9. The members having the same function as in the above-mentioned embodiment will be designated by the same code and their description will be omitted.

As illustrated in FIGS. 8 and 9, a laser beam printer of this embodiment includes the transfer drum 3 having therein a storage section 101 for storing waste toner. In this embodiment, an end of the side-surface transport conveyer 71 disposed on a side surface of the transfer drum 3 is bent in the axis direction of the transfer drum 3 toward the storage section 101 and inserted into a flange 102. The inserted section of the side-surface transport conveyer 71 fits into a bearing 103 fixed to the flange 102, and the bearing 103 and the inserted section of the side-surface transport conveyer 71 are slidable. Moreover, a transfer drum frame 69 is installed on an outer surface of the bearing 103 through a bearing 104. The bearings 103 and 104 permit only the transfer drum 3 to be freely rotated.

With this structure, the waste toner scraped from the transfer drum 3 is stored in the storage section 101 formed in the transfer drum 3 through the circumferential-surface transport conveyer 67 and the side-surface transport conveyer 71. When the transfer drum unit 64 is replaced, the waste toner in the storage section 101 is thrown away together with the transfer drum unit 64.

As described above, in the laser beam printer of this embodiment, since the transfer drum 3 has therein the storage section 101 for storing waste toner, the inner space of the transfer drum 3 is effectively used. With this structure, when storing the waste toner from the photoreceptor drum 7, a sufficient capacity is ensured in the waste toner storage without considering the amount of waste toner from the transfer drum 3. Moreover, by replacing the transfer drum 3, the waste toner is thrown away together with the transfer drum 3.

Consequently, the installation space for the waste toner box 70 for storing waste toner from the transfer drum 3 becomes unnecessary. It is therefore possible to reduce the overall size of the apparatus and easily perform maintenance.

As described above, a first image forming apparatus of the present invention includes: an image carrying body having a surface on which a toner image corresponding to an electrostatic latent image is formed; a developing device having a developer container disposed around the image carrying body; a transfer body for holding recording paper transported between the transfer body and the image carrying body and transferring the toner image on the image carrying body to the recording paper, and a fixing device for fixing the toner image on the recording paper, wherein the image forming apparatus has a main body whose upper section is split into a front split lid section and a rear split lid section so that at least one of the split lid sections is freely opened and closed by a rotational movement thereof, and wherein the transfer body and the fixing device are detachably installed in one of the split lid sections, while the developer container and the image carrying body are disposed below the other split lid section.

With this structure, for example, when a paper jam occurs between the transfer body and the image carrying body, since the upper section of the main body is split into the front split lid section and the rear split lid section and since at least one of the split lid sections is freely opened and closed and has therein the transfer body and fixing device, the image carrying body and the transfer body are brought out of contact with each other by opening one of the split lid sections. As a result, recording paper held between the image carrying body and the transfer body is exposed, thereby permitting an easy removal of the recording paper. Moreover, when one of the split lid sections is opened, the driving path of the image carrying body and the transfer body is separated, allowing the transfer body and the fixing device to be freely rotated. Namely, even when a paper jam occurs inside the fixing device, it is possible to easily remove recording paper.

Furthermore, since the transfer body and the fixing device are detachably installed in one of the split lid sections, maintenance of the transfer drum and the fixing device is easily carried out.

Meanwhile, since the developer container is disposed below the other split lid section, if the split lid section is designed to be opened by a rotational movement thereof, a toner supply operation in the developer container and maintenance of the developer container are easily performed.

In addition, since the split lid section is opened by an upward rotational movement thereof but not drawn in a lateral direction when performing maintenance, it is not necessary to ensure a space in a lateral direction for moving and drawing the main body.

It is thus possible to easily perform maintenance without increasing the installation space.

As described above, in addition to the structure of the first image forming apparatus, a second image forming apparatus of the present invention includes a moving member having a guide section for moving the image carrying body between an operation position and a retracted position, wherein not only one of the split lid sections but also the other split lid section is freely opened and closed, the moving member is deposed below the other split lid section, and the developing device is detachable when the image carrying body is in the retracted position.

With this structure, in the main body, since the developing device and the image carrying body are in close contact with each other, it is hard to pull the developing device in an upward direction for removal by simply opening the upper section. However, with the present invention, not only one of the split lid sections but also the other split lid section is freely opened and closed. Moreover, the moving member having the guiding section is disposed below the other split lid section, and the image carrying body is normally supported in the operation position of the guide section of the moving member. However, when moving the developing device upward for removal, the image carrying body is moved to the retracted position of the guide section. As a result, the developing device and the image carrying body are separated from each other. At this time, the developing device becomes detachable, and there is no obstructions in the upward direction. Therefore, even when the developing device and the image carrying body are in close contact with each other, the developing device is easily removed by moving it in an upward direction. It is thus possible to easily perform maintenance without increasing the installation space.

As described above, in addition to the structure of the first image forming apparatus, a third image forming apparatus of the present invention includes a moving member having a guide section for moving the image carrying body between an operation position and a retracted position, wherein not only one of the split lid sections but also the other split lid section is freely opened and closed, and the guide section is formed so that the image carrying body is guided to come out from the retracted position.

With this structure, in order to take out the image carrying body for maintenance purposes, the other split lid section is opened by a rotational movement thereof and the image carrying body is, for example, laterally moved to the retracted position in the guide section. Since the guide section is formed for guiding the image carrying body to be taken out in a upward direction from the retracted position, it is possible to easily remove the image carrying body in the upward direction along the guide section. Moreover, when removing the image carrying body, it must be moved once to the retracted position from the operation position. It is thus possible to prevent scratches and external light from giving vicious effects on the image carrying body when it is carelessly removed from the apparatus. As a result, maintenance is easily performed without increasing the installation space.

As described above, in addition to the structure of the first image forming apparatus, a fourth image forming apparatus of the present invention includes a storage section for storing waste toner in the transfer body.

With this structure, since the storage space for storing the waste toner is formed inside the transfer body, the internal space of the transfer body is effectively used. Therefore, when storing the waste toner from the transfer body, it is possible to ensure a sufficient space in the waste toner container without considering the amount of the waste toner. Moreover, since the waste toner is thrown away together with the transfer body by replacing the transfer body. Consequently, the installation space for the storage section for storing the waste toner from the transfer body becomes unnecessary. It is therefore possible to reduce the overall size of the apparatus and easily perform maintenance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus having a main body having an upper section that is freely opened and closed, comprising:

a photoreceptor unit including a photoreceptor drum rotating on a supporting shaft, said photoreceptor unit being attachable to and detachable from said main body;

a detachable developing unit disposed in the vicinity of said photoreceptor drum; and a guide section provided in said main body and engaging said supporting shaft such that said photoreceptor unit is slidably disposed on said guide section between an operation position and a retracted position, wherein said developing unit is detachable by opening said upper section of said main body and sliding said photoreceptor unit to the retracted position, thereby allowing said developing unit to be detached from said main body, and further wherein said developing unit is detachable from said main body separately from said photoreceptor unit.

2. The image forming apparatus according to claim 1, wherein a first end of said guide section corresponds to the operation position of said photoreceptor drum, and a second end is open so as to allow said photoreceptor unit to be removed from said main body.

3. The image forming apparatus according to claim 2, wherein said guide section is a substantially L-shaped groove.

4. The image forming apparatus according to claim 3, wherein a corner of the L-shaped groove corresponds to the retracted position.

5. The image forming apparatus according to claim 1, wherein said guide section has a first end and a second end, said supporting shaft staying at the first end when in the operation position and the second end being open so as to allow said photoreceptor unit to be removed from said main body.

6. The image forming apparatus according to claim 5, wherein said guide section is a substantially L-shaped groove.

7. An image forming apparatus comprising:

a main body having an upper section, said upper section including a first lid and a second lid which are freely opened and closed respectively;

an image carrying body having a surface on which a toner image is formed;

a developing device disposed adjacent said image carrying body for applying toner to said image carrying body in order to form the toner image;

a transfer body which rotates in contact with said image carrying body, holds recording paper between said transfer body and said image carrying body, and transfers the toner image from said image carrying body to the recording paper; and a fixing device, having a fixing member, for fixing the toner image on the recording paper with a rotation of said fixing member, wherein said transfer body and said fixing device are detachably installed in said first lid, and said developing device and said image carrying body are installed in said second lid, and wherein said image carrying body and said transfer body are brought out of contact with each other by opening at least one of said first and second lid, and said transfer body and said fixing member become rotatable by opening said first lid.

8. The image forming apparatus according to claim 7, wherein said first and second lids are opened and closed by rotationally moving said first and second lids on respective predetermined shafts.

9. The image forming apparatus according to claim 8, wherein said first lid includes a paper discharge cover in the vicinity of said fixing device, said paper discharge cover being opened and closed, and said fixing device is removable from said main body when said paper discharge cover is opened.

10. The image forming apparatus according to claim 7, further comprising:

a frame for holding said transfer body; and a shutter, held by said frame, for preventing toner from spilling during removal of said transfer drum.

11. The image forming apparatus according to claim 7, further comprising:

waste toner storage means, disposed below said first lid, for storing waste toner;

first transport means for guiding waste toner scraped from said transfer body; and second transport means, connected to said first transport means, for guiding the waste toner to said waste toner storage means, wherein said first and second transport means respectively include a first screw member and a second screw member, and, in operation, said first screw member rotates to transport the waste toner to said second transport means and said second screw member rotates to transport the waste toner from said first transport means to said waste toner storage means.

12. The image forming apparatus according to claim 11, wherein said first said second screw member are within said first and second transport means, respectively, and said first and second transport means define an enclosed channel through which the waste toner is transported.

13. The image forming apparatus according to claim 7, wherein said second lid includes at a lower position therein a guide section for guiding said image carrying body between an operation position and a retracted position, and said guide section guides said image carrying body to be taken out of said main body from the retracted position.

14. The image forming apparatus according to claim 13, wherein one end of said guide section corresponds to an operation position of said image carrying body, and another end is open so as to allow said image carrying body to be guided outward from said main body, and wherein said developing device becomes detachable when said image carrying body is retracted from the operation position.

15. The image forming apparatus according to claim 14, wherein said guide section is a substantially L-shaped groove.

16. The image forming apparatus of claim 14, wherein said image carrying body includes a photoreceptor drum.

17. The image forming apparatus according to claim 7, wherein said transfer body includes therein a storage section for storing waste toner.

18. The image forming apparatus according to claim 7, wherein said transfer body includes therein a storage section for storing waste toner;

first transport means for guiding waste toner scraped from said transfer body; and second transport means, connected to said first transport means, for guiding the toner to said waste toner storage means, and wherein each of said first and second transport means includes therein a screw member, and transports the waste toner by a rotation of said screw member.

* * * * *